United States Patent [19]

Brock et al.

[11] Patent Number: 4,638,747

[45] Date of Patent: Jan. 27, 1987

[54] COAL-FIRED ASPHALT PLANT

[75] Inventors: J. Donald Brock, Chattanooga; James G. May, Hixson, both of Tenn.

[73] Assignee: Astec Industries, Inc., Chattanooga, Tenn.

[21] Appl. No.: 718,070

[22] Filed: Apr. 1, 1985

[51] Int. Cl.[4] ..... F23C 1/10; B28C 5/06; F23D 17/00

[52] U.S. Cl. ..... 110/264; 366/12; 366/25; 110/265; 110/216; 110/101 CC; 110/246

[58] Field of Search ..... 110/260–265, 110/216, 222, 105, 107, 106, 246, 101 CC; 366/25, 11, 12

[56] References Cited

U.S. PATENT DOCUMENTS

| | | | |
|---|---|---|---|
| 862,720 | 8/1907 | Day . | |
| 2,497,088 | 8/1943 | Lykken et al. . | |
| 2,561,388 | 7/1951 | Lykken et al. . | |
| 2,658,644 | 11/1953 | Lowe . | |
| 3,299,841 | 1/1967 | Hemker et al. | 110/262 |
| 3,300,151 | 1/1964 | Zifferer . | |
| 3,319,828 | 5/1967 | Maxwell . | |
| 3,329,313 | 9/1965 | Mayer . | |
| 3,532,253 | 11/1968 | Godwin . | |
| 3,741,532 | 6/1973 | Farnham et al. . | |
| 3,809,373 | 5/1974 | Brock . | |
| 3,828,869 | 8/1974 | Sellers . | |
| 4,089,509 | 5/1978 | Morton et al. . | |
| 4,111,336 | 9/1978 | Ward et al. . | |
| 4,190,370 | 2/1980 | Brock et al. . | |
| 4,211,490 | 7/1980 | Brock et al. . | |
| 4,270,467 | 6/1981 | Drake | 110/216 |
| 4,333,405 | 6/1982 | Michelfelden et al. | 110/265 |
| 4,373,451 | 2/1983 | Grandner et al. | 110/101 CC |
| 4,387,654 | 6/1983 | Binasik et al. | 110/265 |
| 4,441,922 | 4/1984 | Most et al. | 110/216 |
| 4,446,799 | 5/1984 | Anderson | 110/263 |
| 4,457,241 | 7/1984 | Itse et al. | 110/265 |
| 4,509,437 | 4/1985 | Breidenbach et al. | 110/216 |
| 4,515,090 | 5/1985 | Brashears et al. | 110/264 |
| 4,531,461 | 7/1985 | Sayler et al. | 110/265 |

FOREIGN PATENT DOCUMENTS

| | | | |
|---|---|---|---|
| 169514 | 10/1982 | Japan | 110/101 CC |
| 224203 | 12/1983 | Japan | 110/101 CC |

OTHER PUBLICATIONS

The Asphalt Handbook, The Asphalt Institute, July, 1962 Edition.

Excerpt from Chemical Engineering Handbook, 4th Edition by John H. Perry, published by McGraw-Hill.

*Primary Examiner*—Henry C. Yuen

*Attorney, Agent, or Firm*—Jones & Askew

[57] ABSTRACT

The invention comprises a coal-fired burner system for use in a drum mix asphalt plant or drum dryer used for producing asphalt paving composition. Coal to fire the burner is ground to a −200 mesh size by an air-swept rotary impact mill, and a classifier at the exit from the mill controls the size of the particles leaving the mill. The pulverized coal particles are recovered from the exhaust airflow exiting the mill by a fiber filter collector and temporarily stored in a small surge bin. Coal is metered from the surge bin into a primary air conduit leading to the burner. The availability of a small but ready supply of coal in the surge bin provides quick response to a need for increased coal while avoiding the dangerous storage of large quantities of pulverized coal dust. As the weight of coal dust in the surge bin decreases, control circuitry provides for the processing of additional coal to maintain a ready supply of processed coal in the surge bin.

Use of a burner having swirl vanes to create a short cyclonic flame pattern permits the burner to be mounted directly in the upper end of the drum without the need for a separate combustion chamber, but without sending a long flame into the mixing area of the drum where liquid asphalt is introduced, which would cause a fire hazard and pollution problem.

3 Claims, 5 Drawing Figures

COAL-FIRED ASPHALT PLANT

TECHNICAL FIELD

This invention relates generally to apparatus for manufacturing asphalt, and relates more specifically to drum mix asphalt plants and drum dryers incorporating a coal-fired burner.

BACKGROUND OF THE INVENTION

Drum mix asphalt plants for use in preparing asphalt aggregate paving compositions are well known in the art. A typical drum mix asphalt plant is disclosed in U.S. Pat. No. 4,211,490. The plant includes a drum mixer having a drying zone wherein virgin aggregate is dried by agitating the aggregate in a flow of heated air; and a mixing zone wherein the aggregate material is mixed with liquid asphalt to form the desired mixture. The exhaust from the drum is then drawn through a baghouse, where fiber filter elements remove aggregate dust from the airflow. Aggregate dust thus recovered can be re-admitted into the drum to be coated with liquid asphalt and become part of the asphalt composition.

The heat for the drying zone of such drum mixers is typically provided by a burner mounted in the upper end of the drum. Early asphalt plants were fired using coal-fired boilers with a portion of the exhaust from the coal fire going to dry the aggregate. However, crude oil and natural gas soon replaced coal as the fuels of choice in asphalt plants, being much easier to handle and cleaner burning. Hence, nearly all asphalt plants in recent history have used fuel oil or natural gas fired burners to heat and dry the aggregate.

Over the years, natural gas and fuel oil have continued to escalate in price so that the cost per million BTU of most liquid and gaseous fuels is from three to five times that of the solid fuels. Accordingly, a significant savings could be achieved by utilizing coal to fire the asphalt plant. However, since coal tends to burn much dirtier than fuel oil or natural gas, there remained the problem of providing a coal-fired burner which meets pollution standards.

Additionally, pulverized coal creates storage problems, inasmuch as the coal dust is potentially explosive. Thus, it has been considered necessary to pulverize the coal only as needed by the burner to prevent the dangerous storage of pulverized coal. A number of efforts have been made to provide a simple direct fired system that will feed the coal directly into a pulverizer, and then send it out of the pulverizer directly into the burner without any intermediate storage of the pulverized coal particles. However, a significant time lapse has occurred between the time the perception of a need for additional coal and the time the coal is fed into the pulverizer, processed, and supplied to the burner. Therefore, changes of production rate have resulted in very sluggish control. Accordingly, there is a need to provide a coal-fired asphalt plant which allows instantaneous control of the burner without the storage of large quantities of pulverized coal.

Typically, coal for burning in an asphalt plant has been pulverized without specific regard to classification of the particle size. As a result, typically 70–80% of the feed is reduced to −200 mesh. The combustion of coal particles larger than 200 mesh results in an extremely long flame, an undesirable characteristic for a heat source of a drum mix asphalt plant. A long flame increases the temperature at the mixing zone of the drum where liquid asphalt is introduced. Liquid asphalt exposed to high temperatures and steam in the drum mixer produces vapors comprising light end hydrocarbons which are stripped from the liquid asphalt. When a baghouse is used to treat exhaust gases, these light end hydrocarbons appear as oil buildup on the filter elements of the baghouse and are also released through the stack, creating air pollution problems. Many light ends which remain as vapor through the baghouse condense after being exposed to low temperature air on discharge from the plant, and in extreme cases can result in oil stains forming on objects in areas around the asphalt plant. When the plant is operated with this type of process for a sufficient time, there is a high probability of fire occurring in the baghouse, because a spark from burning materials in the drum can ignite oil-soaked bags and damage or destroy the entire baghouse. In addition, the oil which forms in the baghouse can combine with dust to clog the filter elements so that air can no longer pass through, reducing plant productivity and creating difficult cleaning problems. Accordingly, it is necessary to confine the heat to the drying zone of the drum, so as not to expose the liquid asphalt in the mixing zone to high temperatures, an object which is inconsistent with the long flame created by the burning of large coal particles.

In order not to have the coal-fired burner sending long flames down the drum into the mixing zone, it has been necessary to provide a separate combustion chamber within which the coal-fired burner is disposed. However, such combustion chambers require frequent and expensive maintenance. The refractory of the combustion chamber is subject to frequent expansion and contraction as a result of the heating and cooling when the burner is started and stopped. Over a short period of time, uneven expansion can cause structural failure of the refractory, requiring the asphalt plant to be shut down while the refractory is repaired or replaced. Coal slag also can adhere to the refractory surface, subsequently expanding and contracting at a different rate than the refractory material, and result in the erosion of the refractory surface. Accordingly, there is a need to provide a coal-fired asphalt plant which does not require a separate combustion chamber for the burner.

In typical coal-fired asphalt plants of the prior art, large particles are thrown into the burner and are slow to burn. They can be carried down the dryer and all the way to the baghouse before they are totally consumed, creating a condition that can lead to baghouse fires and other serious problems. Thus, there is a need to provide a coal-fired asphalt plant which prevents the possibility of oversized coal particles entering the burner and being carried throughout the plant.

Another inherent problem with conventional coal-fired burners is the emission of sulfur dioxide, which can cause acid-rain. To prevent excess sulfur dioxide emissions, conventional coal-fired burners require expensive fluegas desulfurization equipment. Accordingly, there is a need to provide a coal-fired asphalt plant which emits acceptable levels of sulfur dioxide without the need for expensive fluegas desulfurization equipment.

SUMMARY OF THE INVENTION

As will be seen, asphalt plants constructed according to the present invention overcome these and other problems associated with conventional coal-fired asphalt plants. A drum mixer according to the invention is of generally conventional design with a burner at the upper end where the aggregate is introduced into the drum, and an asphalt injection system disposed approximately half way down the drum to coat the dried aggregate. Flights on the inner surface of the drum in conjunction with the rotation of the drum serve to agitate the aggregate through the heated upper portion of the drum for drying, and serve to mix the asphalt and aggregate thoroughly in the lower portion.

Coal to fuel the burner is stored in a hopper until ready for use. When needed, coal is carried by a belt conveyor to a ceramic-lined, air-swept rotary impact mill where it is pulverized. An exhaust system pulls air through the mill and carries particles of pulverized coal upwardly out of the mill. A variable speed whizzer or classifier mounted above the mill controls the size of the particles allowed to leave the mill, maintaining proper particle size by returning oversized particles to the mill for further pulverizing. Properly sized particles are carried out of the mill in the airstream to a coal particle recovery baghouse, where the coal dust is separated from the airstream by the baghouse filters.

The extremely fine processed coal is moved from the baghouse to a surge pot or weigh hopper, which holds a small reserve of pulverized coal to insure a dependable, uninterrupted flow of fuel to the burner. As coal is withdrawn from the weigh hopper to fuel the burner, reduced weight of material in the hopper signals the conveyor to deliver more coal to the mill. In this manner, coal is ground only as needed, thereby eliminating the dangerous storage of large quantities of pulverized coal dust.

Fuel is supplied to the burner by feeding coal through a variable speed fuel valve into the burner's primary air system. Primary air with the coal fuel entrained, comprising roughly about 10% of the air used, as well as a secondary air stream comprising roughly 90% of the air used, enters the burner tangentially, where the air/fuel mixture is ignited. This tangential air entry, in cooperation with special swirl vanes on the burner itself, creates a flame with a tremendous swirling pattern.

The advantages of this cyclonic flame pattern are several: first, the swirling action creates a low pressure area in front of the fire that actually draws flame and unburned fuel back into the vortex of the flame, thus resulting in more complete combustion and a cleaner burn. Second, the swirling action provides a short flame which generates intense radiant heat and a fast heat transfer to the aggregate. At the same time, however, the short flame confines the heat to a relatively short section of the drum mixer, thereby eliminating the need for a separate combustion chamber, while the temperature of the gas stream further down the drum where liquid asphalt is introduced is significantly reduced. In this manner, the liquid asphalt is not exposed to high temperatures which can strip light end hydrocarbons from the asphalt, causing opacity problems, fires in plant baghouses, and failure to meet pollution standards.

As increased production needs or higher moisture content in the aggregate signals a need for increased heat, a damper on the secondary air system is automatically opened. A venturi tube in the secondary air inlet on the burner senses the increase in the secondary airflow and signals the vane feeder under the weigh hopper to deliver more fuel into the primary airstream for delivery to the burner. Similarly, as decreased production needs or lower moisture content in the aggregate dictate a decrease in the amount of heat needed in the drum, the damper on the secondary air system is automatically closed. The venturi senses the decrease in the secondary flow rate and almost instantaneously signals the vane feeder to deliver less fuel into the primary airstream. This system provides important safeguards in the event that clogged baghouse filters or mechanical failure should reduce the flow of air through the plant. The venture will sense the reduction in the secondary airflow and reduce the fuel supply accordingly, thereby preventing a dangerously rich fuel mixture that could send unburned sparklers through the plant system.

To prevent the emission of excess levels of sulfur dioxide, a by-product of coal combustion, the present invention calls for limestone to be mixed in with the coal which fuels the burner. The limestone mixes with combustion gases and is calcined to form quicklime, which reacts with the sulfur dioxide to form calcium sulfate (gypsum), neutralizing the sulfur dioxide in the process. The gypsum particles are either coated with liquid asphalt to become part of the asphalt product or captured, along with the aggregate dust, in the plant's baghouse. Using this limestone injection method, 50–70% of the sulfur dioxide can be removed from the plant's emissions.

In the case of asphalt plants using lime rock aggregate, such as that found in Florida, or limestone aggregate, such as that found in Tennessee and northern Georgia, the limestone dust from the aggregate can be recovered directly from the system baghouse and metered into the primary air system along with the pulverized coal to neutralize the sulfur dioxide. In plants using other types of aggregate, either limestone can be fed into the mill along with the coal to be pulverized and mixed, or pre-processed limestone dust can be stored in a silo and metered into the primary air system as described above.

Thus, it is an object of the present invention to provide an asphalt plant which operates using coal as fuel.

It is a further object of this invention to provide an asphalt plant which uses a cost-effective fuel source.

It is another object of the present invention to provide a demand-responsive fuel supply system for a coal-fired burner which does not require the storage of large quantities of potentially explosive coal dust.

It is a further object of the present invention to provide a drum mixer or drum dryer with a coal-fired burner which combusts cleanly, safely, and efficiently.

Another object of the present invention is to provide a burner arrangement which confines high temperatures to the upper end of the drum so as not to strip light-end hydrocarbons from the liquid asphalt, without the need for a separate combustion chamber.

It is yet another object of the present invention to provide a coal-processing system which supplies only very fine particles of coal dust to the burner while eliminating slow-to-burn oversize particles.

It is a further object of the present invention to provide a system for supplying coal to the burner which prevents the possibility of an overly rich fuel feed that could send unburned sparklers through the asphalt plant.

Another object of this invention is to provide a coal-fired asphalt plant which emits acceptable levels of sulfur dioxide without the need for expensive fluegas desulfurization equipment.

Other objects, features, and advantages of the present invention will become apparent upon reading the following specifications when taken in conjunction with the drawing and the appended claims.

DETAILED DESCRIPTION OF THE DISCLOSED EMBODIMENT

Figure 1:
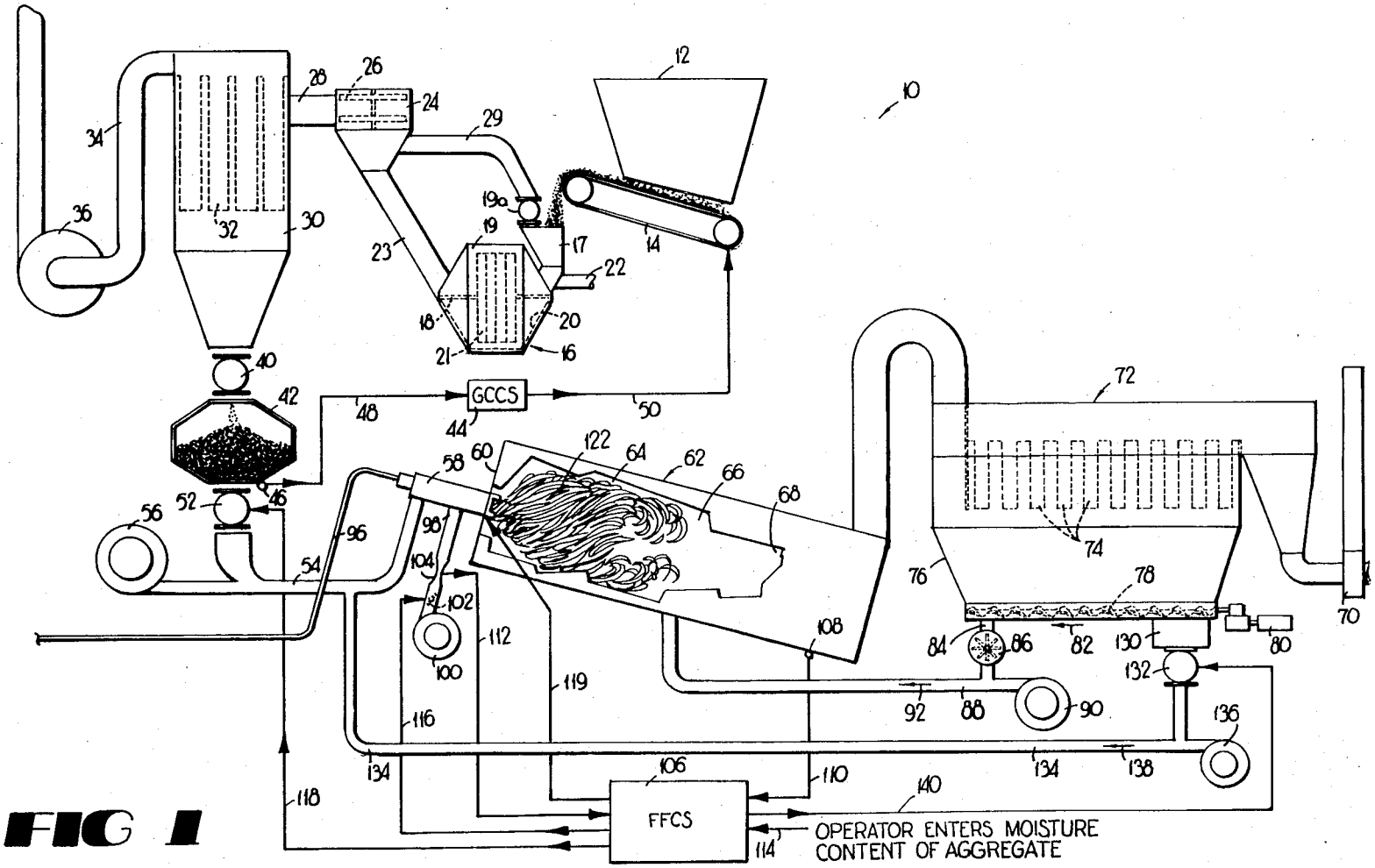
FIG. 1 is a schematic diagram of the preferred embodiment of a coal-fired asphalt plant of the present invention.

Referring now in more detail to the drawing, in which like numerals indicate like elements throughout the several views, FIG. 1 is a schematic drawing of an asphalt plant 10 according to the present invention. Lump coal is stored in a coal hopper 12 and fed as required onto a variable speed belt conveyor 14 for transport to a rotary impact mill 16 for pulverizing. As the conveyor 14 moves the coal to the mill, a permanent magnet (not shown) grabs tramp metal from among the coal that might cause sparks in the pulverizing operation. Coal enters the mill 16 through a chute 17.

The mill 16 of the present invention is a conventional ceramic lined air-swept rotary impact mill well known in the art. The mill is capable of reducing feed material to a fineness such that 100% of the particles are −200 mesh (smaller than 74 microns), and 85% of the particles passed are −325 mesh (smaller than 50 microns). In contrast, a conventional bowl mill or attrition mill can reduce only 80% of the feed to −200 mesh, and only 60–65% to −325 mesh. The importance of a consistently extremely fine pulverized coal product lies in the fact that larger coal particles which are introduced into the burner are slower to burn and can be carried down the drum and all the way through the plant to the system baghouse before they are totally consumed, thereby causing baghouse fires and other serious problems.

The mill 16 includes a rotor 18 horizontally mounted for rotation and driven by conventional motor means (not shown). The rotor runs in a housing 19 having a ceramic liner 20 for durability and low maintenance. A plurality of hammers or beaters 21 project radially from the rotor 18. As the rotor rotates at high speed, a pulverizing action results from the impact and attrition between lumps or particles of the coal being ground, the ceramic liner 20 of the mill housing 19, and the hammers 21. Accordingly, the fineness of the product can be regulated by changing rotor speed, feed rate, or clearance between hammers and the ceramic lining, as well as by changing the number and type of beaters used and the velocity of the airstream sweeping the mill. A small heater (not shown) at the air intake can be used when necessary to help dry coal with high moisture content prior to being fed into the mill.

An airstream created by means disclosed below enters the mill through an air inlet 22 and sweeps through the mill. The pulverized coal is drawn out of the mill by the airstream and through duct 23 to a variable speed classifier or "whizzer" 24, which controls the size of the particles leaving the mill. Oversized coal particles are struck by blades or stators 26 of the classifier 24 and are knocked out of the airstream and back into the mill through a conduit 29 and rotary air lock feeder 19*a* for further pulverizing. Furthermore, a cyclonic effect created within the whizzer directs larger particles to the outside wall of the whizzer and out of the main airstream where they lose velocity and drop. Properly sized coal particles pass through the classifier. The classifier can be adjusted to pass various size coal particles either by regulating the speed of rotation of the blades 26 or by adding or removing blades from the classifier. Thus, even though normal wear of the mill hammers 21 may have decreased the mill's efficiency, the classifier will maintain proper size particles and will assure proper sizing even when using different coals from different sections of the country.

An air conduit 28 leads from the classifier 24 to a grinding circuit baghouse 30 containing fiber filter collectors 32 to separate the coal particles from the moving airstream. An air conduit 34 on the opposite side of the baghouse 30 includes an exhaust fan 36 which provides the flow of air through the mill 16, classifier 24, air conduit 28, baghouse 30, air conduit 34, and out through an exhaust stack 38. The coal dust can be knocked from the collectors 32 in a well known manner, and it falls to the bottom of the baghouse 30.

At the bottom of the grinding circuit baghouse 30 is another air lock 40 which meters the recovered coal dust into a weigh hopper or surge pot 42. The weigh hopper stores enough pulverized coal to operate a burner for about ten minutes, which is sufficient in the present system to assure a dependable, uninterrupted flow of fuel. The weigh hopper 42 is mounted on one or more load cells 46 which provide a signal representing the weight of coal in the hopper.

To avoid the storage of larger quantities of potentially explosive coal dust, the present invention includes the control of the rate at which coal is pulverized so that coal is processed only as needed. To realize this capability, the plant is provided with a grinding circuit control system 44 for receiving the weight indications from the load cell 46 by way of a signalling channel 48. In addition, the control system 44 includes an output channel 50 for controlling the speed at which the conveyor 14 delivers raw coal to the mill 16 for the processing. As the sensing device 46 detects a decrease in the weight of the coal in the weigh hopper 42, the control system 44 increases the rate at which the conveyor 14 delivers coal to the mill 16. When the control system 44 receives signals from the sensing device 46 that the weight of the coal in the weigh hopper 42 has reached the desired level, the rate at which the conveyor 14 delivers coal to the mill 16 is regulated accordingly. In the meantime, the weigh hopper provides a small but ready supply of coal, thereby circumventing the long response time known in prior art systems between the time a need for increased coal is detected and the time the coal has been processed.

A variable speed vane feeder 52 feeds the coal particles from the weigh hopper 42 into a primary air conduit 54. A fan 56 creates a flow of air (the "primary airflow") through the primary air conduit 54, and the coal particles introduced into the primary air conduit become entrained in the airflow and are delivered into a burner 58 mounted in the upper end 60 of a drum mixer 62.

The burner 58 is a high swirl recirculating-type combination coal/oil burner of the type manufactured by Enatech Corporation of Atlanta, Ga. Detailed drawings of the burner, which is not a part of the present invention, are filed concurrently herewith and are hereby incorporated by reference.

The burner 58 has a constant pilot (not shown) fueled by a constant base fuel feed such as oil or natural gas through fuel supply line 96. Air and fuel are delivered to the burner through the primary air conduit 54, and additional air is provided to the burner through a secondary air conduit 98 having a fan 100. The secondary air conduit supplies approximately 90% of the air entering the burner. A damper 102 is disposed within the secondary air conduit 98 to provide control over the rate of the airflow in the secondary conduit (the "secondary airflow"). A venturi 104 disposed within the secondary conduit 98 measures the rate of the secondary airflow.

Figure 4:
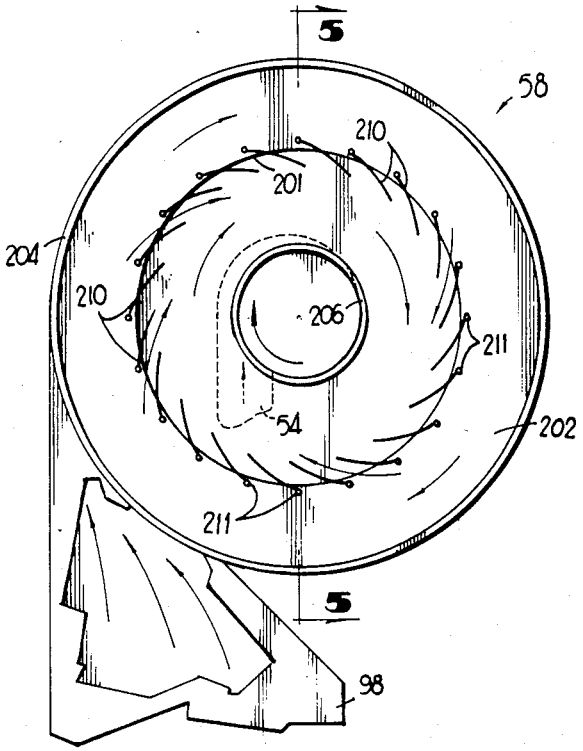
FIG. 4 is a front view of a burner of the asphalt plant of FIG.1.
Figure 5:
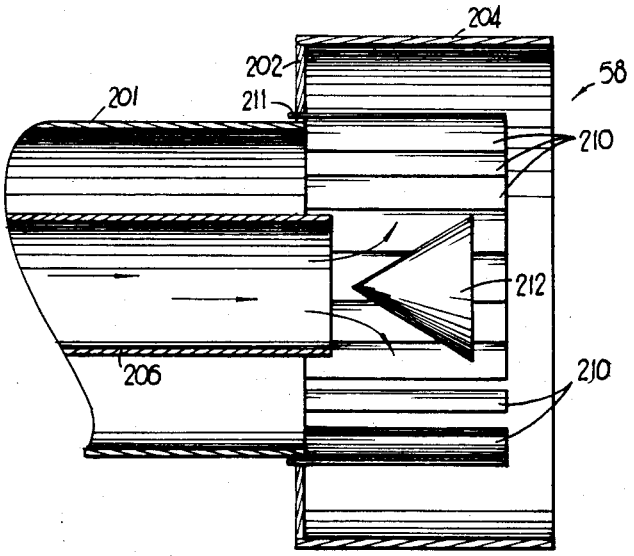
FIG. 5 is a vertical cross sectional view of the burner of FIG.4, taken along line 5—5.

As shown in FIGS. 4 and 5, the burner 58 includes a first cylindrical member 201, an annular connecting plate 202 fixed to the end of the member 201, and a second cylindrical member 204 extending from the annular plate 202 and having a diameter greater than the cylindrical member 201. The open end of the cylindrical member 204 opposite the cylindrical member 201 opens into the drum 62 of the asphalt plant 10. The coal/air mixture in the conduit 54 discharges tangentially into a pipe 206 positioned along the axis of the first and second cylindrical members. The pipe 206 opens into the chamber defined by the second cylindrical member 204. The tangential entry of the mixture causes the mixture to swirl as it moves down the pipe 206. The secondary air passing through the conduit 98 enters the second cylindrical member tangentially and also begins to swirl. The secondary air is directed through a series of curved vanes 210 which are pivotally mounted on shafts 211 journalled in the annular plate 202. The shafts 211 can be rotated by controls (not shown) so as to move the vanes into an essentially closed cylinder roughly even with the first cylindrical member 201, or to move the vanes to guide the secondary air in a swirling pattern toward the center of the chamber where the coal/air mixture leaves the pipe 206. The primary coal/air mixture is swirling in the same direction as the secondary air, as shown in FIG.4, and impinges on a cone 212 suspended at the center of the second cylindrical member 204. The cone 212 directs the coal/air mixture into the oncoming secondary air. Thus, thorough mixing of the primary and secondary airstreams is accomplished.

Figure 2:
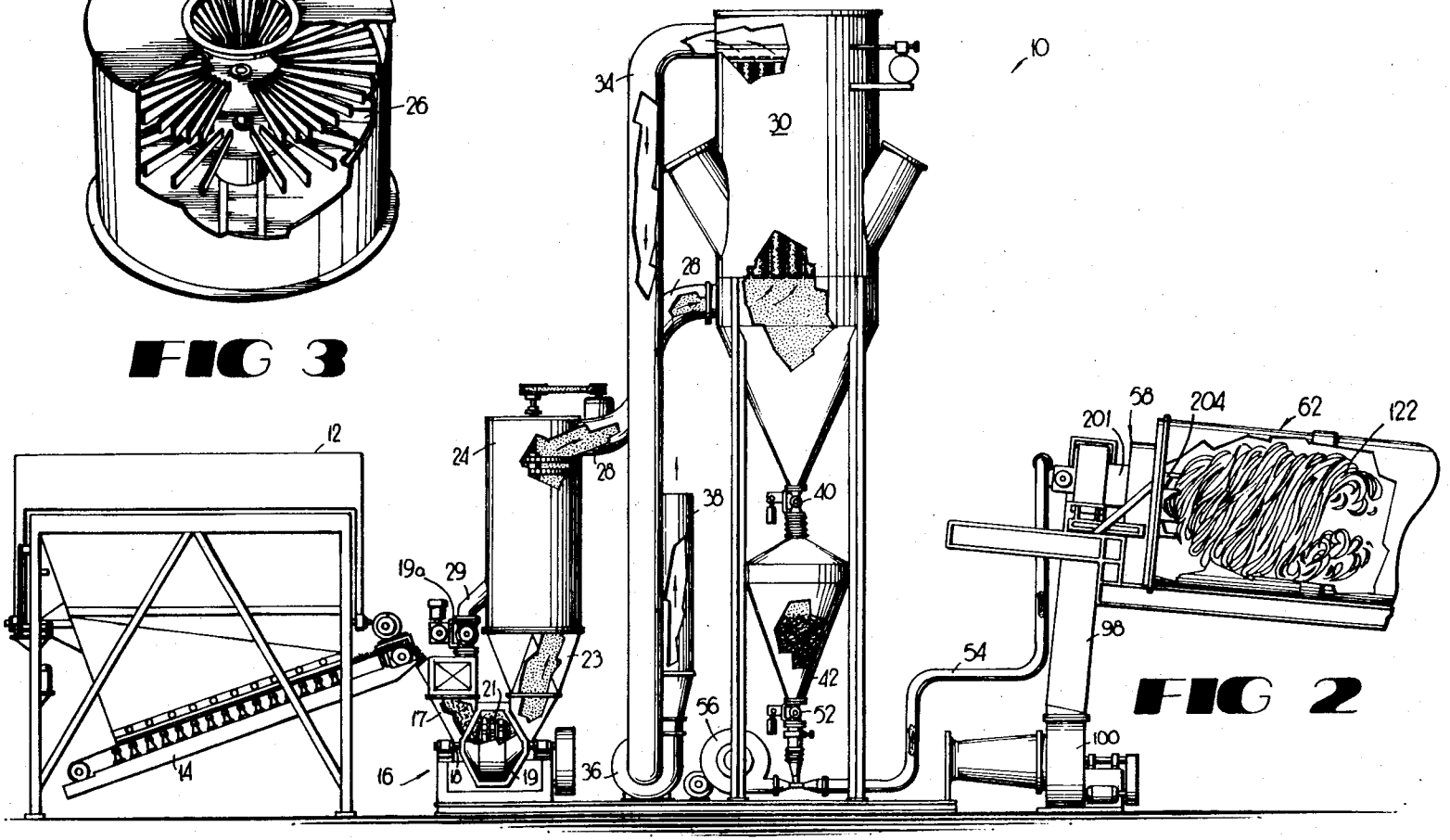
FIG. 2 is a diagrammatic side view of the coal supply and burner system of the asphalt plant of FIG.1.
Figure 3:
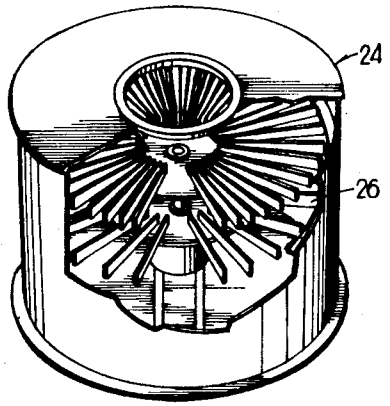
FIG. 3 is a pictorial view of a particle classifier used in the apparatus of FIG.1, with portions broken away to show interior detail.

The resulting swirling mixture is ignited by the pilot and forms flame 122 having the unique shape shown in FIG. 2. The short swirling flame pattern provides several benefits over the long flame of a conventional coal burner. First, since the low pressure area in front of the fire tends to draw unburned fuel back into the flame, combustion is more complete, thereby minimizing fuel consumption while providing a cleaner burn with fewer exhaust emissions.

Second, the short flame allows the burner to be installed directly in the end 60 of the drum mixer 62 without the need for a separate combustion chamber. The combustion area of the burner and drum can be lined with stainless steel rather than refractory material. Also, without a separate combustion chamber, the long flame of a conventional coal burner would tend to fire well down into the drum mixer, heating the entire length of the drum to high temperatures, rather than confining the heat to the drying zone of the drum. Such high temperatures well into the mixing zone of the drum would tend to strip light-end hydrocarbons from the liquid asphalt, resulting in opacity problems, baghouse fires, and failure to meet pollution standards. However, the short flame of the cyclonic burner of the present asphalt plant confines the flame to the uppermost end of the drum and generates an intense radiant heat to dry the aggregate; yet the temperature of the drum farther downstream in the mixing zone is sufficiently reduced so as not to strip light end hydrocarbons from the liquid asphalt.

As previously mentioned, the swirl vanes 210 mounted on the burner 58 form a circular pattern to help direct the secondary airflow entering the burner into a "swirling" pattern. Since the desired short flame pattern is a result of this cyclonic airflow, it is important to maintain a constant swirl velocity of the air in order to provide the aforementioned advantages of clean combustion and confining the heat to the upper end of the drum. To maintain a constant airflow velocity within the swirl of approximately two hundred and forty miles per hour, the vanes 210 are mounted to modulate in response to the volume of air entering the burner. As the amount of air entering the burner decreases, the vanes close to form a tighter circle, and hence a tighter swirl pattern; and as the volume of air increases, the vanes open to form a larger circle, thereby providing for a constant swirl velocity despite varying rates of airflow entering the burner.

The drum mixer 62 is of a conventional design well known in the art. Aggregate is introduced into the drum mixer 62 through the upper end 60 of the drum. The drum 62 is mounted for rotation, and flights (not shown) on the inner surface of the drum, in conjunction with the rotation of the drum, serve to agitate the aggregate through a heated upper or drying section 64 of the drum. Liquid asphalt is injected into the drum at an intermediate point 66 to coat the dried aggregate, and the rotation of the drum and the flights on the inner surface of the drum serve to mix the liquid asphalt and aggregate thoroughly in a lower or mixing section 68 of the drum. An exhaust fan 70 pulls air through the drum mixer and through a conventional system baghouse 72, where aggregate dust is filtered from the airflow by fiber filter elements 74. This drum mixer and baghouse arrangement is well known to those skilled in the art and is similar to that disclosed in U.S. Pat. No. 4,211,490, which patent is incorporated herein by reference.

The fiber filter elements 74 are disposed above a dust collection chamber 76 which takes the shape of a generally V-shaped trough, the bottom of which opens into a screw auger 78 extending along the length of the dust collection chamber. The auger 78 is rotated by a conventional drive apparatus 80 to carry dust particles in the direction of arrow 82 toward the auger outlet 84. A rotary air lock 86 is connected between the auger outlet 84 and a dust return conduit 88, and a blower 90 is connected to the end of the dust return conduit upstream from the outlet of the rotary air lock. The blower 90 delivers a stream of air moving through the dust return conduit 88 in the direction indicated by the arrow 92. The rotary air lock 86 meters aggregate dust into the airstream, which conveys the dust through the conduit 88 back to the drum mixer 62, where it is readmitted to the drum mixer and coated within liquid asphalt to become part of the asphalt mix in the manner disclosed in the aforementioned U.S. Pat. No. 4,211,490.

To prevent the possibility of a potentially dangerous overly rich fuel mixture being introduced into the burner, the present invention includes the control of the coal/air mixture in the primary air conduit 54 responsive to the flow rate of the air in the secondary conduit 98. To realize this capability, the plant is provided with a fuel feed control system 106 which receives temperature indications from temperature sensing device 108 disosed within the drum 62 to measure the temperature of the asphalt mix, and flow rate indications of the secondary airflow from venturi 104 in the secondary air conduit 98, by way of their respective signalling channels 110, 112. In addition, the control system 106 receives information concerning the moisture content of the aggregate as input by the plant operator through signalling channel 114. Further, the control section of apparatus 106 includes output control channel 116 for controlling the position of the damper 102 in the secondary air conduit 98, output control channel 118 for controlling the rate at which the vane feeder 52 feeds coal into the primary airflow, and output control channel 119 for controlling the damper effect of the vanes 210 by rotating the shafts 211.

The control system 106 monitors the temperature of the asphalt mix as detected by temperature sensing device 108, and the moisture content of the aggregate. As the temperature of the asphalt mix drops or the moisture content of the aggregate increases, signalling a need for increased heat output from the burner 58, the control system 106 signals the damper 102 in the secondary air conduit 98 to open. As the secondary airflow rate increases, the venturi 104 senses the increase and signals the control system 106. In turn, the control system increases the rate at which the vane feeder 52 feeds coal into the primary air conduit 54. In this manner, an increase in the amount of coal delivered to the burner 58 is always preceded by an increase in the amount of air delivered to the burner.

Similarly, when the control system 106 receives indications that the temperature of the asphalt mix is too high or that the moisture content of the aggregate is reduced, it closes the damper 102 in the secondary air conduit 98 and/or the vanes 210. The venturi 104 senses a drop in the rate of secondary airflow and signals the control system 106, which in turn decreases the rate at which coal is being fed into the primary air conduit 54.

By controlling the rate at which coal is being fed into the primary airflow in response to the rate of the secondary airflow, an important safety feature is provided in the event of an interruption in normal plant operation. Should clogged filter elements 74 in the system baghouse 72 or a mechanical failure of one of the plant's fans cause the secondary airflow to decrease, the venturi 104 in the secondary conduit 78 will sense the decrease in the airflow and signal the control system 106 to reduce the rate at which the vane feeder 52 introduces coal into the primary airflow. Thus, as the air being delivered to the burner is decreased, the amount of coal also decreases, and the possibility of a dangerously rich fuel mixture reaching the burner is avoided.

Those skilled in the art will understand that the control system can also monitor the flow of the virgin aggregate to the drum, and the stack temperature of exhaust from the plant, and utilize such measurements for control functions such as those disclosed in U.S. Pat. Nos. 4,089,509 and 4,190,370.

It will be appreciated by those skilled in the art that the grinding circuit control system 44 and the fuel feed control system 106 may comprise microcomputers, and that the functions of the control systems 44 and 106 may be controlled by the same microcomputer if desired. The control systems 44 and 106 may be embodied in a general purpose programmable computer or a microprogrammed computing apparatus, which may be best suited to perform the procedures described above. The selection and programming of such computers to accomplish the system and its operation as described herein are well within the abilities of a person of ordinary skill in the art. However, such a computer is not essential to the asphalt plant control systems of the present invention, and other devices capable of performing the tasks of the control systems 44 and 106 are within the scope of the invention.

In order to neutralize sulfur dioxide emissions resulting from coal combustion without the need for expensive fluegas desulfurization equipment, the present invention calls for the introduction of limestone into the burner. The limestone, when exposed to the heat of the combustion process, calcines to quicklime, which reacts with sulfur dioxide to form calcium sulfate (gypsum). The gypsum dust is then entrained in the airstream flowing through the drum, where it is either coated with liquid asphalt in the mixing zone to become part of the asphalt product, or passes through the drum to the baghouse, where it is filtered out of the airstream.

Three possible methods are provided for introducing limestone into the burner. For asphalt plants using aggregate containing lime, such as lime rock aggregate from Florida or limestone aggregate from Tennessee and northern Georgia, aggregate dust which is filtered out of the airstream by the system baghouse can be recovered and metered into the primary airstream, where it is delivered to the burner along with the coal dust. In this manner, a waste product can be recycled and utilized to reduce sulfur dioxide emissions.

To accomplish this method of neutralizing sulfur dioxide emissions using lime dust recovered by the system baghouse 72, a surge bin 130 is mounted in the bottom of the dust collection chamber 76 to collect a reserve of lime dust. A vane feeder 132 mounted in the bottom of the surge bin meters air into a dust return conduit 134. A fan 136 provides a stream of air moving through the conduit 134 in the direction indicated by the arrow 138. The dust introduced into the conduit 134 becomes entrained in the airstream and is introduced into the primary air conduit 76. In this manner, the lime is introduced into the burner, where it calcines and neutralizes the sulfur dioxide emissions as described above.

It has been found that approximately one part by weight of lime dust per hundred parts by weight of coal dust will satisfactorily neutralize the burner's sulfur dioxide emissions. Since this requires a relatively small portion of the dust collected by the system baghouse 72, the remaining dust can be returned to the drum to be mixed into the asphalt mixture as previously described.

As will be appreciated by those skilled in the art, as the amount of coal introduced into the burner is increased, the amount of sulfur dioxide emitted by the burner will increase accordingly. The amount of lime introduced into the burner must therefore be increased proportionately to neutralize the additional sulfur dioxide emissions. Accordingly, the fuel feed control system 106 further includes an output control channel 140 for controlling the rate at which the vane feeder 132 meters lime dust into the dust return conduit 134. Thus, as the control system 106 regulates the rate at which the vane feeder 52 introduces coal into the primary air conduit 54, it regulates the rate at which lime dust is delivered into the primary air conduit proportionately.

For asphalt plants using an aggregate which does not contain sufficient quantities of lime, the lime can be supplied to the burner in one of two ways. First, limestone can be introduced into the mill 16 along with the raw coal, where it is pulverized and mixed along with the coal and stored in the weigh hopper 42. The coal/-lime mixture is then fed into the primary air conduit 56 by the vane feeder 52. Alternatively, preprocessed limestone dust can be stored in a separate silo (not shown) and metered into the primary air conduit 56, where it mixes with the coal dust as it is being conveyed to the burner.

Those skilled in the art will understand that the coal pulverizing and feeding system described herein can be used with a drum dryer in an asphalt plant in which the liquid asphalt is mixed with aggregate or recycled material outside the drum. In a drum dryer, the burner 58 can be located at either the top end of the drum or at the bottom end in a counter-flow configuration.

OPERATION

To manufacture asphalt according to the method and apparatus of the present invention, lump coal is initially stored in the hopper 12. When needed, coal is delivered onto the belt conveyor 14 for transport to the mill 16 for pulverizing. As the coal moves past the magnet (not shown), tramp metal is grabbed from among the coal.

The coal is introduced into the mill 16 through the rotary air lock 17. An airstream created by the exhaust fan 36 enters the mill through air inlet 22 and sweeps through the mill. The coal is struck by the rotary hammers 21, and a pulverizing action results from the impact and attrition between the lumps of coal, the ceramic liner 20 of the mill housing 19, and the hammers 21, which grinds the coal into particles small enough to be lifted upwardly out of the mill by the airstream. As the coal particles entrained in the airflow exit the mill, the classifier 24 intercepts 100% of the particles larger than 200 mesh and 85% of the particles larger than 325 mesh, allowing only properly sized particles to pass and returning oversized particles to the mill for further processing.

The pulverized coal entrained in the airflow is then carried through the air conduit 28 to the grinding circuit baghouse 30, where fiber filter elements 32 separate the coal particles from the moving airstream. An air lock 40 at the bottom of the baghouse meters the coal particles thus recovered into the weigh hopper 42.

The variable speed vane feeder 52 at the bottom of the weigh hopper 42 feeds the pulverized coal into the primary air conduit 54 for supply to the burner 58. As coal is provided to the burner, the weight of the coal in the hopper 42 decreases. The sensing elements 46 detect this weight decrease and signal the grinding circuit control system 44, which regulates the speed of the conveyor 14 to deliver more lump coal to the mill 16. When the control system 44 receives a signal from the sensing device 46 that the weight of the coal in the weigh hopper 42 has reached the desired level, the control system regulates the speed at which the conveyor 14 delivers coal to the mill 16 accordingly. In this manner, coal is processed to supply the weigh hopper only as actually needed, thereby preventing the storage of large amounts of potentially explosive coal dust. At the same time, the ready supply of fuel available from the weigh hopper prevents the time lag inherent in direct fired burners and permits nearly instantaneous response when the burner requires additional fuel. Thus, the semi-direct fired system of the present invention provides the same quick response during start up, shut down, and production change as natural gas or oil fired burners.

Primary air, with the coal particles entrained therein, and secondary air, in a ratio of approximately 10/90, are delivered into the burner 58 tangentially. The constant pilot fueled by the base fuel feed entering through the fuel supply line 64 ignites the coal/air mixture. The swirl vanes 120 mounted on the front of the burner, in conjunction with the tangential air entry, create a cylconic flame pattern in front of the burner. The cyclonic pattern creates a low pressure area in front of the flame which draws the flame and unburned fuel back into the vortex to provide a short flame and more complete combustion. Thus, the flame is confined to the upper portion 64 of the drum and does not extend into the mixing section 68 of the drum, where high temperatures could cause light-end hydrocarbons to be stripped from the liquid asphalt.

Aggregate is introduced into the upper end 60 of the drum 62 in the conventional manner. The flights (not shown) on the interior of the drum, in conjunction with the rotation of the drum, cause the aggregate to be agitated in the heated air in the drying zone 64 of the drum. As the aggregate is tumbled from the drying zone down the inclined drum, it reaches the intermediate point 66 where liquid asphalt is injected into the drum. The liquid asphalt coats the aggregate in the conventional manner, and the flights on the inner surface of the drum, in conjunction with the rotation of the drum, thoroughly mix the liquid asphalt and aggregate in the mixing zone 68 of the drum to form the asphalt mix.

The exhaust fan 70 provides a flow of air through the drum mixer. Aggregate dust resulting from the agitation of the aggregate in the drying zone 64 becomes entrained in the moving airstream. Some of the dust may become coated with liquid asphalt in the mixing zone 68 and hence become part of the asphalt mixture. The remaining airborne aggregate dust is carried by the moving airstream to the system baghouse 72, where the fiber filter elements 74 recover the dust. The dust thus recovered is collected in the dust collection chamber 76 in the bottom of the baghouse 72. The auger 78 conveys the dust to the rotary air lock 86, which meters the dust into the dust return conduit 88. An airstream provided through the conduit 88 by the blower 90 conveys the dust through the conduit back to the drum 62, where it is re-admitted to the drum and coated with liquid asphalt to become part of the asphalt mix. The asphalt mixture is then withdrawn from the lower end of the drum in the conventional manner.

As the temperature sensing device 108 detects a decrease in the temperature of the asphalt mix, or as aggregate having a higher moisture content is introduced into the drum, the fuel feed control system 106 senses the need for more heat and signals the damper 102 in the secondary air conduit 98 to open. As the damper opens, airflow through the secondary air conduit 98 increases. The venturi 104 in the secondary air conduit senses this inreased flow of air and signals the fuel feed control system 106 which, in turn, regulates the vane feeder 52 to increase the flow of coal into the primary air conduit 54. In this manner, should a clogged baghouse or exhaust system failure unexpectedly reduce the airflow in the drum, and thus the flow of air entering the burner, the venturi 104 in the secondary air conduit 98 will sense the decrease and immediately signal the vane feeder 52 to reduce the fuel supply, preventing the possibility of an overly rich fuel mixture which could send unburned sparklers throughout the plant.

To neutralize the sulfur dioxide produced by the combustion of coal, lime is injected into the burner. When exposed to the combustion gases and high temperatures, the lime calcines to quicklime, which reacts with sulfur dioxide to form calcium sulfate (gypsum). The gypsum dust is entrained in the airstream flowing through the drum and eventually recovered by the system baghouse.

In the preferred embodiment of the invention, when the aggregate contains lime, such as lime rock or limestone, aggregate dust is collected in the surge bin 130 disposed in the bottom of the dust collection chamber 76 of the system baghouse 72. The vane feeder 132 meters the lime dust from the surge bin 130 into the dust return conduit 134. The fan 136 creates an airstream through the conduit 134. The lime dust which is introduced into the conduit becomes entrained in the airstream and is conveyed through the conduit to the primary air conduit 76. The lime dust is then metered into the primary airflow along with the coal dust to be introduced into the burner. As the fuel feed control system regulates the rate at which the vane feeder 52 feeds coal into the primary air conduit 56, it also regulates the rate at which the vane feeder 132 feeds lime dust into the dust return conduit 134 for introduction into the primary air conduit. In this manner, the relative proportions of coal and lime dust remain constant.

When the aggregate does not contain sufficient quantities of lime, pulverized lime dust is provided and stored in a separate silo (not shown), whence it is introduced into the primary air conduit 76 as described before. Alternatively, limestone chunks can be introduced into the mill 16 along with the lump coal, where it is pulverized and mixed with the coal. The coal/lime mixture is stored in the weigh hopper 42 and metered into the primary air conduit as needed.

Finally, it will be understood that the preferred embodiment of the present invention has been disclosed by way of example, and that other modifications may occur to those skilled in the art without departing from the scope and spirit of the appended claims.

What is claimed is:

1. A coal-fired burner system for use with an asphalt plant having a rotary drum, said burner system comprising:

means for pulverizing coal to particles of a predetermined size;

exhaust means for creating an exhaust airflow through and out of said pulverizing means so that the particles of pulverized coal are entrained in said exhaust airflow and carried out of said pulverizing means;

means for recovering pulverized coal particles from said exhaust airflow;

means in communication with said coal recovery means for storing said pulverized coal particles recovered from said exhaust airflow;

a burner having swirl vanes to provide a cyclonic flame pattern, mounted in one end of said rotary drum;

means for providing a primary flow of air to enter said burner substantially tangentially;

means for introducing said pulverized coal particles from said coal particle storage means into said primary airflow, whereby a mixture of air and coal is delivered into said burner;

means for providing a secondary flow of air to enter said burner substantially tangentially and to mix with said primary airflow with coal particles entrained therein;

means for controlling the rate of said secondary airflow to said burner;

means for detecting said rate of said secondary airflow;

means responsive to a change in said rate of said secondary airflow for changing the rate at which coal particles are delivered from said coal particle storage means into said primary airflow, whereby the rate at which fuel is delivered into said burner is responsive to the rate of said secondary airflow; and means associated with said burner for igniting said mixture of primary and secondary air with coal particles entrained therein.

2. A coal-fired burner system for use with an asphalt plant having a rotary drum, said burner system comprising:

a mill for pulverizing coal to particles of a predetermined size;

exhaust means for creating an exhaust airflow through and out of said mill so that said particles of pulverized coal are entrained in said exhaust airflow and carried out of said mill;

fiber filter collector means for recovering said pulverized coal particles from said exhaust airflow;

a weigh hopper in communication with said fiber filter collector means for storing said pulverized coal particles recovered from said exhaust airflow;

a burner having swirl vanes to provide a cyclonic flame pattern, mounted in one end of said rotary drum;

means for providing a primary flow of air to enter said burner substantially tangentially;

means for introducing said pulverized coal particles from said coal particle storage means into said primary airflow, whereby a mixture of air and coal is delivered into said burner;

means for providing a secondary flow of air to enter said burner substantially tangentially and to mix with said primary airflow with coal particles entrained therein;

a damper disposed in said secondary airflow and responsive to a need for a change in the amount of heat provided to said rotary drum for changing the rate of said secondary flow of air to the burner;

means for detecting said rate of said secondary airflow;

means responsive to a change in said rate of said secondary airflow for changing the rate at which coal particles are delivered from said coal particle storage means into said primary airflow, whereby the amount of fuel delivered into said burner is responsive to said rate of said secondary airflow; and means associated with said burner for igniting said mixture of primary and secondary air with coal particles entrained therein.

3. A coal-fired burner system for use with an asphalt plant having a rotary drum, said burner system comprising:

a rotary impact mill for pulverizing coal to particles smaller than 200 mesh;

an exhaust fan for creating an exhaust airflow through and out of said rotary impact mill so that said particles of pulverized coal are entrained in said exhaust airflow and carried out of said mill;

a baghouse for recovering said pulverized coal particles from said exhaust airflow;

a weigh hopper in communication with said baghouse for storing said pulverized coal particles recovered from said exhaust airflow;

a burner having swirl vanes to provide a cyclonic flame pattern, mounted in one end of said rotary drum;

a primary air conduit in tangential communication with said burner;

a first supply fan for providing a flow of primary air through said primary air conduit to enter said burner substantially tangentially;

a rotary air lock for introducing pulverized coal particles from said weigh hopper into said primary air conduit, whereby a mixture of air and coal is delivered into said burner;

a secondary air conduit in tangential communication with said burner;

a second supply fan for providing a flow of secondary air through said secondary air conduit to enter said burner substantially tangentially and to mix with said primary airflow with coal particles entrained therein;

a damper disposed in said secondary air conduit and responsive to a need for a change in the amount of heat provided to the rotary drum for changing the rate of said secondary flow of air to said burner;

a venturi tube disposed in said secondary air conduit for detecting said rate of said secondary airflow therein;

a rotary air lock responsive to a change in said rate of said secondary airflow for changing the rate at which coal particles are delivered from said weigh hopper into said primary air conduit, whereby the amount of fuel delivered into said burner is responsive to said rate of said secondary airflow in said secondary air conduit; and a constant pilot associated with said burner for igniting said mixture of primary and secondary air with coal particles entrained therein.

* * * * *